US010996035B2

(12) United States Patent
Bucher

(10) Patent No.: US 10,996,035 B2
(45) Date of Patent: May 4, 2021

(54) FIN-STABILIZED SUB-CALIBER PROJECTILE THAT CAN BE FIRED FROM A RIFLED BARREL, AND METHOD FOR THE PRODUCTION THEREOF

(71) Applicant: RWM Schweiz AG, Zurich (CH)

(72) Inventor: Ruedi Bucher, Dielsdorf (CH)

(73) Assignee: RWM Schweiz AG, Zurich (CH)

( * ) Notice: Subject to any disclaimer, the term of this patent is extended or adjusted under 35 U.S.C. 154(b) by 518 days.

(21) Appl. No.: 15/753,092

(22) PCT Filed: Jun. 28, 2016

(86) PCT No.: PCT/EP2016/065056
§ 371 (c)(1),
(2) Date: Feb. 15, 2018

(87) PCT Pub. No.: WO2017/001428
PCT Pub. Date: Jan. 5, 2017

(65) Prior Publication Data

US 2018/0216922 A1 Aug. 2, 2018

(30) Foreign Application Priority Data

Jul. 1, 2015 (DE) ..... 10 2015 110 627.2

(51) Int. Cl.
*F42B 14/06* (2006.01)
*F42B 14/02* (2006.01)

(52) U.S. Cl.
CPC ..... *F42B 14/062* (2013.01); *F42B 14/02* (2013.01); *F42B 14/06* (2013.01); *F42B 14/061* (2013.01); *F42B 14/064* (2013.01); *F42B 14/067* (2013.01)

(58) Field of Classification Search
CPC ..... F42B 14/06; F42B 14/061; F42B 14/062; F42B 14/067; F42B 14/02
See application file for complete search history.

(56) References Cited

U.S. PATENT DOCUMENTS 3,620,167 A * 11/1971 Romer ..... F42B 14/061 102/521
4,140,061 A * 2/1979 Campoli ..... F42B 14/061 102/521

(Continued)

FOREIGN PATENT DOCUMENTS

CH 684804 A5 * 12/1994 ..... F42B 12/06
DE 2039719 A1 3/1971

(Continued)

OTHER PUBLICATIONS

International Search Report:PCT/EP2016/065056 dated Sep. 2, 2016.

(Continued)

*Primary Examiner* — Benjamin P Lee
(74) *Attorney, Agent, or Firm* — Muncy, Geissler, Olds & Lowe, P.C.

(57) ABSTRACT

A fin-stabilized sub-caliber projectile adapted to be fired from a rifled barrel, the projectile having a penetrator with a tail fin assembly, a sabot arranged on the penetrator and having at least two sabot segments circumferentially joined to one another that are separated from one another after leaving the barrel by centrifugal forces acting on the projectile during firing. The sabot includes a main body and a front guide flange that is adapted to be supported on an inner wall of the barrel and a rear guide flange arranged at an axial distance. A connecting section of the sabot is arranged between the front guide flange and the rear guide flange and has a smaller outer diameter than the front guide flange or the rear guide flange. The sabot and the penetrator are joined together in a positive manner in a region of the rear guide flange.

10 Claims, 3 Drawing Sheets

(56) References Cited

U.S. PATENT DOCUMENTS

| | | | | | |
|---|---|---|---|---|---|
| 4,142,467 | A * | 3/1979 | Stahlmann | F42B 14/08 | 102/523 |
| 4,702,172 | A * | 10/1987 | Wallow | F42B 14/061 | 102/521 |
| 4,747,191 | A * | 5/1988 | Montier | F42B 14/067 | 86/52 |
| 5,404,816 | A * | 4/1995 | Burri | F42B 14/064 | 102/523 |
| 5,728,968 | A * | 3/1998 | Buzzett | F42B 12/06 | 102/364 |
| 6,324,986 | B1 * | 12/2001 | Rossmann | F42B 14/062 | 102/521 |
| 7,013,811 | B1 * | 3/2006 | Sebasto | F42B 14/061 | 102/520 |
| 2004/0244631 | A1 * | 12/2004 | Eches | F42B 14/061 | 102/521 |
| 2005/0016413 | A1 * | 1/2005 | Eches | F42B 14/061 | 102/521 |
| 2013/0000506 | A1 * | 1/2013 | Minnicino, II | F42B 14/061 | 102/521 |
| 2013/0125774 | A1 * | 5/2013 | Volkmann | F42B 12/06 | 102/519 |
| 2016/0363425 | A1 * | 12/2016 | Minnicino, II | F42B 14/061 | |

FOREIGN PATENT DOCUMENTS

| | | | | |
|---|---|---|---|---|
| DE | 3033041 | A1 * | 3/1982 | F42B 14/061 |
| DE | 3051030 | A1 * | 5/1986 | F42B 14/06 |
| DE | 3050474 | C1 | 6/1986 | |
| DE | 3827830 | A1 * | 3/1990 | F42B 14/061 |
| DE | 3930255 | A1 * | 3/1991 | F42B 14/061 |
| DE | 4022462 | A1 * | 1/1992 | F42B 12/06 |
| DE | 3843503 | A1 | 5/1992 | |
| DE | 102013000180 | B3 * | 4/2014 | F42B 14/067 |
| EP | 03000373 | B1 | 6/1992 | |
| EP | 0645600 | A1 | 3/1995 | |
| EP | 1333242 | A1 * | 8/2003 | F42B 14/061 |
| EP | 1384971 | A1 * | 1/2004 | F42B 14/061 |
| EP | 1445573 | A1 * | 8/2004 | F42B 14/061 |
| WO | WO-2004017015 | A1 * | 2/2004 | F42B 14/02 |

OTHER PUBLICATIONS

Translation of the Written Opinion of the International Seaching Authority: PCT/EP2016/065056 dated Oct. 31, 2017.

* cited by examiner

FIN-STABILIZED SUB-CALIBER PROJECTILE THAT CAN BE FIRED FROM A RIFLED BARREL, AND METHOD FOR THE PRODUCTION THEREOF

This nonprovisional application is the National Stage of International Application No. PCT/EP2016/065056, which was filed on Jun. 28, 2016, and which claims priority to German Patent Application No. 10 2015 110 627.2, which was filed in Germany on Jul. 1, 2015, and which are both herein incorporated by reference.

BACKGROUND OF THE INVENTION

Field of the Invention

The present invention relates to a fin-stabilized sub-caliber projectile that can be fired from a rifled barrel, having a penetrator with a tail fin assembly and having a discardable sabot that is arranged on the penetrator and includes multiple sabot segments circumferentially joined to one another, which segments are separated from one another after leaving the barrel by the centrifugal forces acting on the projectile during firing. The invention further relates to a method for producing a sub-caliber projectile of this nature.

Description of the Background Art

Projectiles of this nature are known from EP 0 300 373 B1, for example. They often are fired from automatic weapons in the mid-caliber range (20-50 mm). The discardable sabot here is formed essentially of a cylindrical main body, made of plastic with predetermined breaking points, which is supported circumferentially over its entire length against the inner wall of the applicable weapon barrel, and a metal insert joined to the rear of the main body. This metal insert is provided with a carrier thread that, in a corresponding thread of the penetrator, serves to transmit to the penetrator the thrust and spin forces acting on the sabot during firing. The relevant main body has a rotating band that transmits the full spin corresponding to the pitch of the spiral flutes of the applicable weapon barrel and the muzzle velocity of the projectile to the sabot and through the carrier thread to the penetrator.

However, it is a disadvantage of prior art projectiles of this nature that the thick-walled design of the main body, which usually is manufactured in an injection-molding process, leads to problems in the production thereof. Because of the relatively long cooling times, long cycle times are necessary in the production of the sabot. Moreover, due to the great wall thickness of the main body, defects such as voids occur frequently in the plastic material, which can then result in deflection errors of the penetrator after exiting the weapon barrel. The larger the caliber of the projectiles is, the thicker the walls of the main body of the sabot are, and the more frequently the above-described problems occur.

A fin-stabilized sub-caliber projectile that can be fired from a rifled barrel is likewise known from DE-OS 2039719, in which the sabot is assembled from multiple sabot segments made of a light metal or plastic that are held together by means of suitable rotating bands.

For reasons of weight saving, the sabot of this projectile has a main body that has a front guide flange that can be supported against the inner wall of the barrel and a rear guide flange arranged at an axial distance. The connecting section of the sabot located between the two guide flanges has a smaller outside diameter than the guide flanges.

For force transmission to the penetrator of the gas pressure forces acting on the sabot when the projectile is fired, an annular groove recessed into the penetrator is located in the region of the rear guide portion of the main body, in which groove a multi-part carrier member of the sabot that is matched to the groove shape of the penetrator engages. Both the rotating bands and the carrier member are designed such that the full spin is not transmitted from the two rotating bands to the sabot during firing of the projectile because of slip between the rotating bands and the sabot, and the full spin of the sabot likewise is not transmitted from it to the penetrator due to slip between the sabot and penetrator.

One disadvantage of projectiles of this nature is that the sabots, and hence also the penetrators, have considerable differences with regard to their spin rate when leaving the barrel. However, the smaller the centrifugal forces are that act on the sabot at emergence from the barrel, the smaller the speed and symmetry are in the discarding of the sabot segments, which can likewise result in deflection errors of the penetrators and thus in an increase in projectile spread in the target area.

SUMMARY OF THE INVENTION

It is therefore an object of the present invention to provide, with reference to EP 0 300 373 B1, which is incorporated herein by reference, a fin-stabilized sub-caliber projectile that can be fired from a rifled barrel, the sabot of which is light and stable and the penetrators of which have smaller deflection errors after leaving the barrel than is the case with comparable prior art sub-caliber projectiles. In addition, a method for the production of a projectile of this type is to be disclosed.

The invention is based primarily on the idea of arranging on the penetrator of the sub-caliber projectile a sabot that transmits full spin, the main body of which sabot is made of a light metal alloy and, for reasons of weight saving, has a front guide flange that can be supported on the inner wall of the barrel and a rear guide flange arranged at an axial distance, wherein the connecting section of the sabot located between the two guide flanges has a smaller outside diameter than the guide flanges. In addition to this two-flange contour, for reasons of further weight saving the main body has axial bores that pass through the front guide flange and extend to the rear guide flange.

It has proven to be advantageous if the diameter of the axial bores is chosen such that the region between the penetrator and the relevant bore where the main body has its smallest wall thickness acts as a predetermined breaking point along which the sabot segments separate from one another on account of the centrifugal forces that act on them after leaving the weapon barrel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
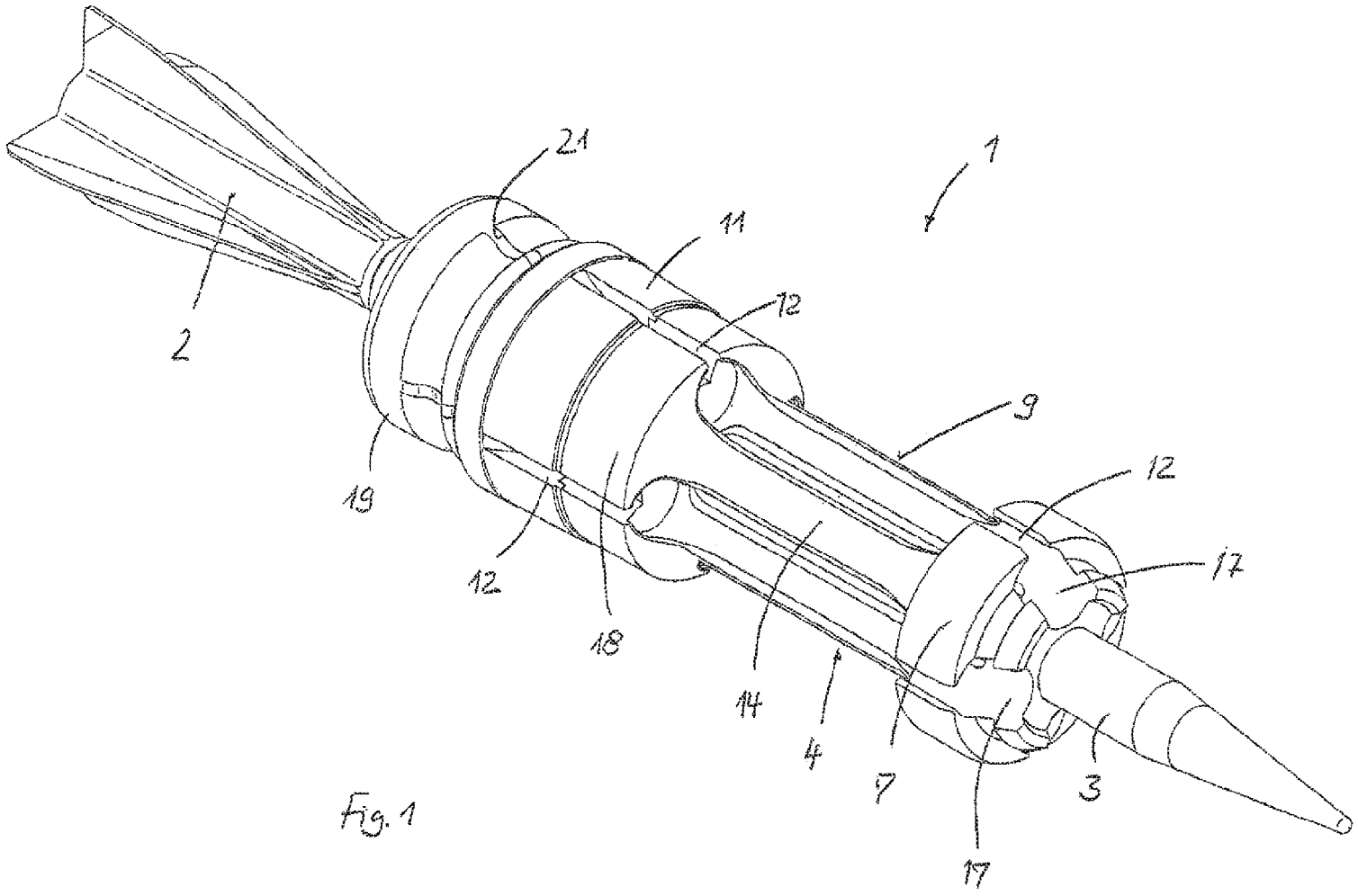
FIG. 1 the perspective view of a sub-caliber projectile according to the invention, FIG. 2 a longitudinal cross-section through the projectile shown in FIG. 1, and FIG. 3 an enlarged front view of the projectile shown in FIG. 1.
Figure 2:
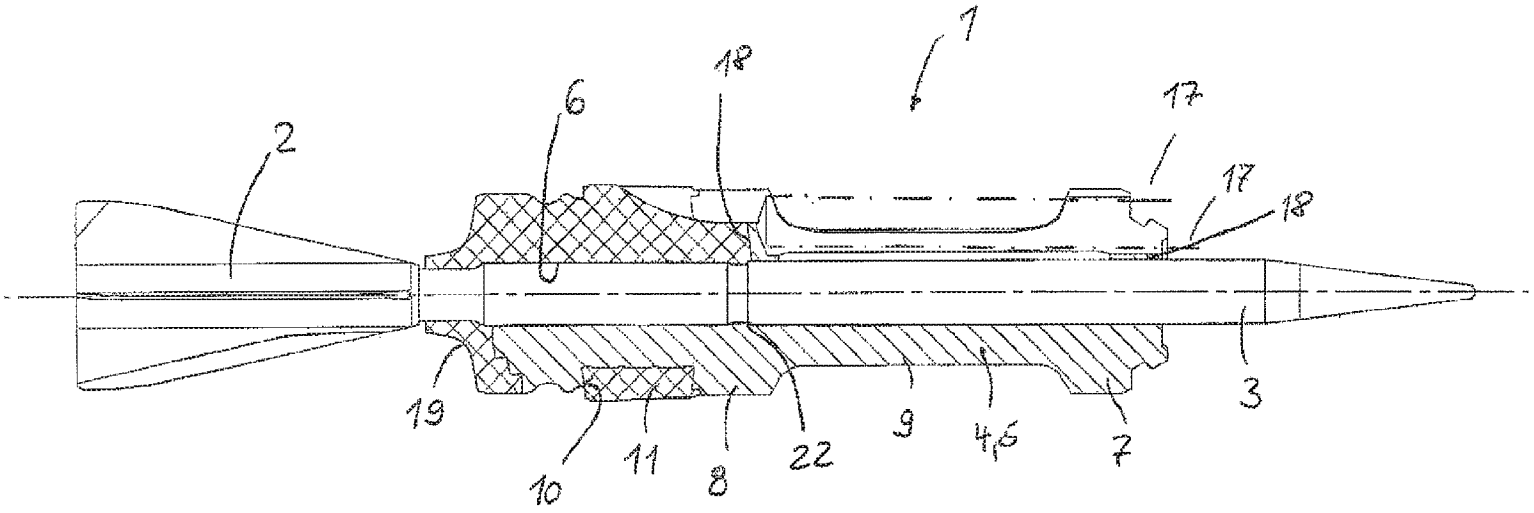
Figure 3:
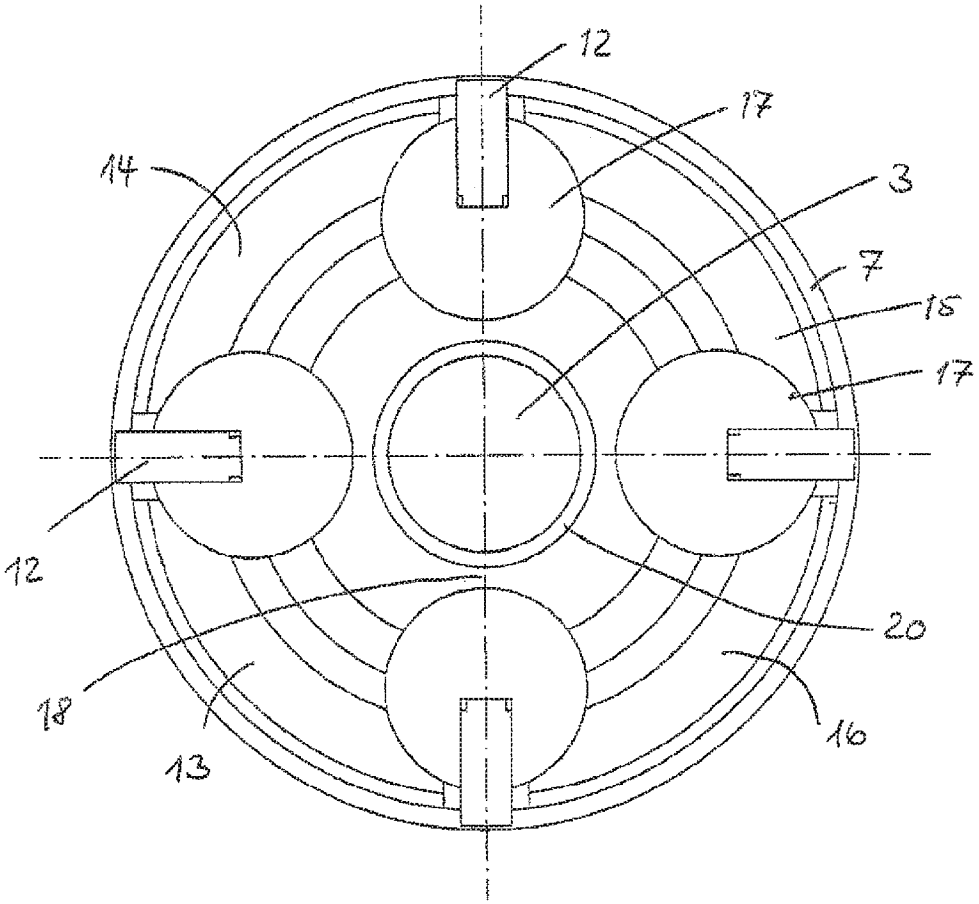

Labeled with 1 in FIGS. 1 and 2 is a fin-stabilized sub-caliber projectile according to the invention that includes a penetrator 3 joined to a tail fin assembly 2, and a discardable sabot 4 arranged on the penetrator 3.

The sabot 4 includes a main body 5 made of an aluminum alloy, which is joined to the penetrator 3 by a threaded connection 6. This threaded connection 6 achieves the result that the thrust and spin forces acting on the sabot 4 within a weapon barrel during firing of the projectile 1 are transmitted to the penetrator 3 without slip.

The main body 5 has a front guide flange 7 and a rear guide flange 8 arranged at an axial distance. Both guide flanges 7, 8 serve to support the sabot 4 on the inner wall of the applicable weapon barrel when the projectile 1 is in the loaded state. The two guide flanges 7, 8 of the sabot 4 are joined by a connecting section 9, which for reasons of weight saving has a smaller outside diameter than the guide flanges 7, 8.

On the outer circumference of the rear guide flange 8, a sealing and rotating band 11 made of plastic is located inside a circumferential recess 10 of the main body 5.

In addition, the main body 5 has multiple axially-extending, longitudinal grooves 12 uniformly distributed over the circumference, which in this embodiment laterally border four sabot segments 13-16 of the sabot 4 that are connected circumferentially to one another.

For further weight saving in the sabot 4, the main body 5 contains four bores 17 that pass axially through the front guide flange 7 and extend to the rear guide flange 8 along the longitudinal grooves 12. These bores also serve to create a predetermined breaking point 18. To this end, the diameter of the bores 17 is chosen such that the resulting region 18 between the penetrator 3 and the relevant bore 17, where the main body 5 has its smallest wall thickness, can act as a predetermined breaking point along which the sabot segments 13-16 can separate from one another after leaving the barrel. Alternatives for incorporation of predetermined breaking points are known from practice.

At the rear side, the main body 5 is provided with a rear seal 19 made of plastic to ensure propellant gases cannot enter the central bore 20 that accommodates the penetrator or enter the longitudinal grooves 12.

When the projectile 1 is fired, the sealing and rotating band 11 is pressed into the rifling grooves of the applicable weapon barrel by the force of the propellant gases, and causes a rotary motion of the sabot 4 as well as a corresponding rotary motion of the penetrator 3 via the threaded connection 6. As soon as the projectile 1 has left the barrel, the predetermined breaking points 18 tear along the longitudinal grooves 12 as a result of the centrifugal forces acting on them, and the sabot segments 13-16 are discarded at high speed and symmetrically with regard to the flight path of the projectile 1.

A preferred method for producing the projectile disclosed above is described below.

Starting from a blank that already possesses the outer contour of the main body 5 as well as the central bore 20 for the penetrator 3 and the thread for positive connection of the penetrator 3 and sabot 4, the four bores 17 for weight reduction are, if desired, introduced from the front side of the front guide flange 7 in the axial direction to the rear guide flange 8. To prevent slip during transmission of spin between the rotating band 11 and the sabot 8, the base of the recess 10 of the rotating band preferably is provided with knurling on the entire circumference. To protect against sinking into the land/groove profile in the barrel, the sabot is coated by means of an anodic oxidation method. This coating is primarily important at the two guide flanges 7 and 8, and is distinguished by its hardness and abrasion resistance.

The prefabricated penetrator 3 is now screwed into the sabot 4 via threads until it rests against the thread stop 22 of the sabot 4 in a positive manner.

Next, the sealing and rotating band 11 is introduced into the recess 10 of the rear guide flange 8, and at the same time the rear seal 19 is introduced by means of a plastic injection molding method. This is made possible because the rotating band region 10 is connected to the region of the rear seal 19 by means of longitudinal slots 21.

The tail fin assembly 2 is subsequently screwed onto the penetrator as a complete unit.

It is a matter of course that the invention is not limited to the exemplary embodiment described above. Thus, the sabot can be composed of only two or three sabot segments, for example. Moreover, the sealing and rotating bands can also be made of a different suitable material, such as sintered metals, instead of plastic.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A fin-stabilized sub-caliber projectile adapted to be fired from a rifled barrel, the projectile comprising:

a penetrator with a tail fin assembly; and a discardable sabot arranged on the penetrator, the discardable sabot having at least two sabot segments circumferentially joined to one another, the segments being separated from one another after the projectile leaves the barrel due to centrifugal forces acting on the projectile during firing, wherein the discardable sabot includes a main body made of a light metal alloy, the main body having a front guide flange that is adapted to be supported on an inner wall of the barrel and a rear guide flange arranged at an axial distance from the front guide flange, wherein a connecting section of the discardable sabot is arranged between the front guide flange and the rear guide flange and has a smaller outer diameter than the front guide flange or the rear guide flange, wherein the discardable sabot and the penetrator are joined together via a positive connection in a region of the rear guide flange, wherein a sealing and rotating band is fastened onto the outer circumference of the rear guide flange, and wherein the main body has axially-extending, longitudinal grooves uniformly distributed over a circumference of the main body, each of the longitudinal grooves extending continuously through the front guide flange and the rear guide flange, and the main body has axially-extending, longitudinal bores that pass axially through an interior of the front guide flange and extend towards and terminate at a surface of the rear guide flange that faces the front guide flange, each of the bores being disposed radially inward from a respective one of the longitudinal grooves, such that at least within the front guide flange, the longitudinal grooves extend into the bores, and wherein the longitudinal grooves and the bores laterally border the sabot segments.

2. The fin-stabilized sub-caliber projectile according to claim 1, wherein a diameter of the bores is chosen such that a region of the main body between the penetrator and each of the bores has a smaller wall thickness than other regions of the main body and acts as a predetermined breaking point along which the sabot segments separate from one another after leaving the barrel.

3. The fin-stabilized sub-caliber projectile according to claim 1, wherein the main body is made of an aluminum alloy.

4. The fin-stabilized sub-caliber projectile according to claim 1, wherein the positive connection between the discardable sabot and the penetrator is a threaded connection.

5. The fin-stabilized sub-caliber projectile according to claim 1, wherein the sealing and rotating band is made of plastic.

6. The fin-stabilized sub-caliber projectile according to claim 1, wherein the bores are positioned radially inward from the longitudinal grooves, such that in the radial direction of the main body, the bores are positioned between the longitudinal grooves and the penetrator.

7. The fin-stabilized sub-caliber projectile according to claim 1, wherein the main body further includes a central bore, the penetrator extending through the central bore.

8. The fin-stabilized sub-caliber projectile according to claim 1, wherein the bores have a larger cross-sectional area than the longitudinal grooves.

9. A method for producing a fin-stabilized sub-caliber projectile that is adapted to be fired from a rifled barrel, the projectile having a penetrator with a tail fin assembly, a discardable sabot arranged on the penetrator, the discardable sabot having at least two sabot segments circumferentially joined to one another, the discardable sabot including a main body made of a light metal alloy, the main body having a front guide flange that is adapted to be supported on an inner wall of the barrel and a rear guide flange arranged at an axial distance from the front guide flange, a connecting section of the discardable sabot is arranged between the front guide flange and the rear guide flange and has a smaller outer diameter than the front guide flange or the rear guide flange, a sealing and rotating band is fastened onto the outer circumference of the rear guide flange, and the main body has axially-extending, longitudinal grooves uniformly distributed over a circumference of the main body, each of the longitudinal grooves extending continuously through the front guide flange and the rear guide flange, and the main body having axially-extending, longitudinal bores that pass axially through an interior of the front guide flange and extend towards and terminate at a surface of the rear guide flange that faces the front guide flange, each of the bores being disposed radially inward from a respective one of the longitudinal grooves, such that at least within the front guide flange, the longitudinal grooves extend into the bores, the method comprising:

providing the penetrator;

providing a blank that already has the outer contour of the main body, the outer contour including the front guide flange, the rear guide flange, the connecting section and the longitudinal grooves, and the blank also including a central bore for the penetrator to extend therethrough and a thread for a positive connection of the penetrator and the discardable sabot;

introducing the bores from a front side of the front guide flange to extend in the axial direction through to and terminating at the rear guide flange;

after introducing the bores, screwing the penetrator into the central bore of the discardable sabot until the penetrator rests against a thread stop of the discardable sabot;

introducing the sealing and rotating band into a recess provided in the outer circumference of the rear guide flange;

introducing a rear seal via a plastic injection molding method; and connecting the tail fin assembly to the penetrator.

10. The method according to claim 9, wherein the introduction of the sealing and rotating band and the introduction of the rear seal takes place substantially simultaneously.

* * * * *